US009482066B2

(12) United States Patent
MacKenzie et al.

(10) Patent No.: US 9,482,066 B2
(45) Date of Patent: Nov. 1, 2016

(54) DOWNHOLE TOOL ACTIVATION

(71) Applicant: NOV Downhole Eurasia Limited, Stonehouse (GB)

(72) Inventors: Alan MacKenzie, Aberdeenshire (GB); Matthew Shaw, Montrose (GB)

(73) Assignee: NOV DOWNHOLE EURASIA LIMITED, Stonehouse (GB)

( * ) Notice: Subject to any disclaimer, the term of this patent is extended or adjusted under 35 U.S.C. 154(b) by 510 days.

(21) Appl. No.: 13/754,736

(22) Filed: Jan. 30, 2013

(65) Prior Publication Data

US 2013/0192897 A1 Aug. 1, 2013

(30) Foreign Application Priority Data

Jan. 31, 2012 (GB) ..... 1201652.3

(51) Int. Cl.

| | |
|---|---|
| ***E21B 23/00*** | (2006.01) |
| ***E21B 7/00*** | (2006.01) |
| ***E21B 10/26*** | (2006.01) |
| ***E21B 47/00*** | (2012.01) |
| ***E21B 10/32*** | (2006.01) |

(52) U.S. Cl.

CPC ..... *E21B 23/00* (2013.01); *E21B 7/00* (2013.01); *E21B 10/26* (2013.01); *E21B 10/32* (2013.01); *E21B 23/006* (2013.01); *E21B 47/00* (2013.01)

(58) Field of Classification Search

CPC ..... E21B 23/006

See application file for complete search history.

(56) References Cited

U.S. PATENT DOCUMENTS

| | | | |
|---|---|---|---|
| 855,983 | A | 6/1907 | Rider |
| 904,344 | A | 11/1908 | Mapes |
| 1,667,190 | A | 2/1926 | Campbell |
| 1,897,206 | A | 12/1931 | McCann |
| 2,112,026 | A | 8/1935 | Jones |

(Continued)

FOREIGN PATENT DOCUMENTS

| | | | |
|---|---|---|---|
| CA | 2093331 | C | 8/2001 |
| CN | 202064834 | U | 12/2011 |

(Continued)

OTHER PUBLICATIONS

Search Report for UK Patent Application No. GB1301554.0 dated May 16, 2013, 3 pages.

(Continued)

*Primary Examiner* — David Andrews
*Assistant Examiner* — Michael Goodwin
(74) *Attorney, Agent, or Firm* — Conley Rose, P.C.

(57) ABSTRACT

An apparatus for use in controlling first and second downhole tools includes a first cyclical indexing mechanism associated with a first downhole tool, and a second cyclical indexing mechanism associated with a second downhole tool, wherein the first indexing mechanism defines at least three sequential indexing positions within a cycle and the second indexing mechanism defines at least two sequential indexing positions within a cycle. The apparatus includes at least one actuator for actuating the first and second indexing mechanisms in response to a common stimulus to cause said first and second indexing mechanisms to advance between respective indexing positions so as to permit co-ordination of the operational states of the associated first and second downhole tools. The apparatus may be used for controlling first and second under reamers or for controlling an under reamer and a corresponding stabilizer.

21 Claims, 7 Drawing Sheets

(56) References Cited

U.S. PATENT DOCUMENTS

| | | | | | |
|---|---|---|---|---|---|
| 3,351,144 | A | | 11/1967 | Park | |
| 3,433,313 | A | | 3/1969 | Brown | |
| 3,771,611 | A | | 11/1973 | Omura et al. | |
| 3,912,006 | A | | 10/1975 | Nutter | |
| 4,319,648 | A | | 3/1982 | Cherrington | |
| 4,697,652 | A | | 10/1987 | Walk | |
| 4,889,197 | A | | 12/1989 | Boe | |
| 4,915,172 | A | | 4/1990 | Donovan et al. | |
| 5,014,780 | A | | 5/1991 | Skipper | |
| 5,046,557 | A | | 9/1991 | Manderscheid | |
| 5,074,355 | A | * | 12/1991 | Lennon | 166/55.1 |
| 5,201,817 | A | | 4/1993 | Hailey | |
| 5,325,932 | A | | 7/1994 | Anderson et al. | |
| 5,351,758 | A | | 10/1994 | Henderson et al. | |
| 5,368,114 | A | | 11/1994 | Tandberg et al. | |
| 5,511,627 | A | | 4/1996 | Anderson | |
| 5,529,126 | A | * | 6/1996 | Edwards | 166/331 |
| 5,560,440 | A | | 10/1996 | Tibbitts | |
| 5,722,489 | A | * | 3/1998 | Lambe et al. | 166/269 |
| 5,735,359 | A | | 4/1998 | Lee et al. | |
| 6,378,632 | B1 | | 4/2002 | Dewey et al. | |
| 6,668,949 | B1 | | 12/2003 | Rives | |
| 6,948,561 | B2 | | 9/2005 | Myron | |
| 7,168,493 | B2 | | 1/2007 | Eddison | |
| 8,365,843 | B2 | | 2/2013 | Hall et al. | |
| 8,540,035 | B2 | | 9/2013 | Xu et al. | |
| 2003/0111236 | A1 | | 6/2003 | Serafin et al. | |
| 2003/0155155 | A1 | | 8/2003 | Dewey et al. | |
| 2004/0060710 | A1 | | 4/2004 | Marshall | |
| 2004/0168832 | A1 | * | 9/2004 | Russell et al. | 175/321 |
| 2004/0222022 | A1 | | 11/2004 | Nevlud et al. | |
| 2005/0205305 | A1 | | 9/2005 | Stout et al. | |
| 2005/0241856 | A1 | | 11/2005 | Lassoie et al. | |
| 2006/0144623 | A1 | | 7/2006 | Ollerensaw et al. | |
| 2006/0162935 | A1 | | 7/2006 | MacDougall | |
| 2007/0012440 | A1 | * | 1/2007 | Lee | 166/216 |
| 2007/0089912 | A1 | | 4/2007 | Eddison et al. | |
| 2008/0070038 | A1 | | 3/2008 | Vincent et al. | |
| 2008/0105465 | A1 | | 5/2008 | Radford et al. | |
| 2008/0257608 | A1 | | 10/2008 | Fanuel et al. | |
| 2010/0089583 | A1 | | 4/2010 | Xu et al. | |
| 2011/0048723 | A1 | | 3/2011 | Edwards | |
| 2011/0192612 | A1 | | 8/2011 | Swietlik | |
| 2011/0214963 | A1 | | 9/2011 | Beylotte et al. | |
| 2011/0240301 | A1 | | 10/2011 | Robison | |
| 2012/0199366 | A1 | | 8/2012 | Gaskin et al. | |
| 2012/0205108 | A1 | | 8/2012 | Stang | |
| 2013/0133949 | A1 | | 5/2013 | Xu et al. | |
| 2014/0008071 | A1 | | 1/2014 | Patterson et al. | |
| 2014/0131107 | A1 | | 5/2014 | Southard | |
| 2014/0131109 | A1 | | 5/2014 | Mahajan et al. | |
| 2014/0144642 | A1 | | 5/2014 | Lindsay et al. | |

FOREIGN PATENT DOCUMENTS

| | | | | |
|---|---|---|---|---|
| EP | 0301890 | A2 | | 2/1989 |
| GB | 872547 | | | 7/1961 |
| GB | 2401384 | A | | 11/2004 |
| GB | 2446294 | A | | 8/2008 |
| GB | 2478998 | | | 9/2011 |
| WO | 00/31371 | A1 | | 6/2000 |
| WO | 2004/097163 | A1 | | 11/2004 |
| WO | 2005/103435 | A1 | | 11/2005 |
| WO | 2007/017651 | A1 | | 2/2007 |
| WO | 2008/070052 | A2 | | 6/2008 |
| WO | 2010/054407 | A1 | | 5/2010 |
| WO | 2010/116152 | A2 | | 10/2010 |
| WO | 2011/115941 | A1 | | 9/2011 |
| WO | WO 2011117602 | A2 | * | 9/2011 |
| WO | 2013/016354 | A3 | | 1/2013 |

OTHER PUBLICATIONS

GB1201652.3 Search Report Under Section 17(5) dated Mar. 27, 2012, 3 pages.

Courville, David F. et al., "Wellbore Enlargement for a Deepwater Casing Program: Case Study and Developments," Society of Petroleum Engineers, presented at the IADC/SPE Drilling Conference, Dallas, Texas, Mar. 2-4, 2004, IADC/SPE 87153, pp. 1-11.

* cited by examiner

DOWNHOLE TOOL ACTIVATION

FIELD

The present invention relates to apparatus and methods for use in controlling first and second downhole tools and, in particular though not exclusively, for use in controlling first and second under reamers or for use in controlling an under reamer and a corresponding stabilizer.

BACKGROUND

Under reaming open hole sections during drilling operations using hydraulic and/or mechanically activated downhole tools has become accepted practice in the oil and gas industry. The under reamed hole section improves equivalent circulating densities during drilling, aids the subsequent installation of casing strings due to increased clearance between casing and the open hole and, conversely, makes possible tighter clearance casing programs which may be desirable during the construction of deeper wells. It has now become common practice to under ream sections of well bore using multi-cycle hydraulic under reamers.

It is known to control a multi-cycle downhole tool using an indexing mechanism which is configured to repeatedly toggle the operational state of the downhole tool between a de-activated state in which the downhole tool is in a radially retracted configuration and an activated state in which the downhole tool is in a radially extended configuration. In such methods, actuation of the indexing mechanism is often achieved by circulating a ball to depth. However, such known indexing mechanisms may not permit control of multiple downhole tools on the same drill string.

SUMMARY

According to a first aspect of the present invention there is provided an apparatus for use in controlling first and second downhole tools, comprising:

a first cyclical indexing mechanism associated with a first downhole tool, said first indexing mechanism defining at least three sequential indexing positions within a cycle, wherein each indexing position corresponds to an operational state of the first downhole tool;

a second cyclical indexing mechanism associated with a second downhole tool, said second indexing mechanism defining at least two sequential indexing positions within a cycle, wherein each indexing position corresponds to an operational state of the second downhole tool; and at least one actuator for actuating the first and second indexing mechanisms in response to a common stimulus to cause said first and second indexing mechanisms to advance between respective indexing positions so as to permit co-ordination of the operational states of the associated first and second downhole tools.

The apparatus may permit the co-ordination of operational states for the first and second downhole tools in a preferred co-ordinated cyclical sequence to permit the first and second downhole tools to perform a desired downhole operation.

The apparatus may provide greater flexibility in the number and/or sequence of operational states of the first and second downhole tools compared with a known apparatus for use in controlling first and second downhole tools. This may permit greater control over the co-ordination of the operation of the first and second downhole tools compared with a known apparatus.

The apparatus may permit the co-ordinated reconfiguration of the operational state of the first and/or second downhole tools by advancing the indexing positions of the first and second indexing mechanisms in response to a single common stimulus. This may have the advantage of simplifying and/or speeding up downhole operations.

When the first indexing mechanism defines three sequential indexing positions within a cycle and the second indexing mechanism defines two sequential indexing positions within a cycle, the resulting co-ordinated cyclical sequence of operational states for the first and second downhole tools may comprise six predetermined combinations of operational states within a cycle.

The second indexing mechanism may define at least three sequential indexing positions within a cycle.

When the first and second indexing mechanisms each define three sequential indexing positions within a cycle, the resulting co-ordinated cyclical sequence of operational states for the first and second downhole tools may comprise three predetermined combinations of operational states within a cycle.

At least two sequential indexing positions of the first indexing mechanism may correspond to the same operational state.

At least two sequential indexing positions of the first indexing mechanism may correspond to different operational states.

At least two sequential indexing positions of the second indexing mechanism may correspond to the same operational state.

At least two sequential indexing positions of the second indexing mechanism may correspond to different operational states.

Each of the first and second downhole tools may have a plurality of different operational states.

Each of the first and second downhole tools may have an activated operational state and a de-activated operational state. For example, each of the first and second downhole tools may have an activated operational state in which the downhole tool is in a radially extended configuration and a de-activated operational state in which the downhole tool is in a radially retracted configuration. Each of the first and second downhole tools may have an activated operational state denoted ON and a de-activated operational state denoted OFF.

When the first and second indexing mechanisms each define three sequential indexing positions within a cycle, the resulting co-ordinated cyclical sequence of operational states for the first and second downhole tools may comprise (OFF, OFF), (OFF, ON) and (ON, OFF), where the first operational state of each co-ordinated pair of operational states in the sequence corresponds to the first downhole tool and the second operational state of each co-ordinated pair of operational states corresponds to the second downhole tool.

When the first and second indexing mechanisms each define three sequential indexing positions within a cycle, the resulting co-ordinated cyclical sequence of operational states for the first and second downhole tools may comprise (OFF, OFF), (OFF, ON) and (ON, ON).

The apparatus may comprise a first actuator for actuating the first indexing mechanism and a second actuator for actuating the second indexing mechanism.

The first and second downhole tools may be joined and/or share a common housing.

The first and second downhole tools may form part of the same tubing string, drill string or the like.

The first and second downhole tools may be the same or different (e.g. of a similar type; or of different types).

The first and/or second downhole tools may comprise an under reamer, a stabilizer for stabilizing an under reamer, a centralizer, a cutter, a drill, a directional drilling mechanism, a packer, a bridge plug, a straddle, a perforation gun, a slip, a gripping element and/or the like.

The apparatus may comprise one or more further cyclical indexing mechanisms associated with one or more further downhole tools. Each further indexing mechanism may define at least two sequential indexing positions within a cycle, wherein each indexing position corresponds to an operational state of the corresponding further downhole tool(s). The at least one actuator may be configured to actuate the further indexing mechanism(s) via the common stimulus to cause said further indexing mechanism(s) to advance between indexing positions so as to co-ordinate the operational states of the associated further downhole tool(s) with the operational states of the first and second downhole tools in a cyclical sequence.

The apparatus may comprise one actuator for each indexing mechanism.

The common stimulus may comprise the passage of a communication member downhole.

The apparatus may be configured to receive and/or detect the communication member downhole.

The apparatus may be configured to actuate the first and second indexing mechanisms in response to receipt and/or detection of the communication member downhole.

The communication member may comprise a ball, dart and/or the like.

The apparatus may comprise a downhole receiver for receiving and/or detecting the communication member at a downhole location. The apparatus may be configured to actuate the first and second indexing mechanisms in response to receipt and/or detection of the communication member by the downhole receiver.

The apparatus may comprise a first downhole receiver for receiving and/or detecting the communication member at a first downhole location.

The apparatus may be configured to actuate the first indexing mechanism in response to receipt and/or detection of the communication member by the first downhole receiver.

The apparatus may comprise a second downhole receiver for receiving and/or detecting the communication member at a second downhole location.

The apparatus may be configured to actuate the second indexing mechanism in response to receipt and/or detection of the communication member by the second downhole receiver.

The apparatus may comprise a downhole restriction such as a downhole seat for receiving the communication member.

The downhole restriction may be configured for engagement with the communication member.

The apparatus may be configured to actuate the first and second indexing mechanisms in response to engagement of the communication member with the downhole restriction.

The communication member and/or the downhole restriction may be configured to form a downhole seal when the communication member engages the downhole restriction.

The apparatus may be configured to permit pumping of fluid downhole against the action of the downhole seal to cause a change in downhole fluid pressure which serves to actuate the first and second indexing mechanisms.

The apparatus may comprise a first downhole restriction such as a first downhole seat for receiving the communication member (e.g. the first downhole receiver may comprise the first downhole restriction).

The first downhole restriction may be configured for engagement with the communication member.

The apparatus may be configured to actuate the first indexing mechanism in response to engagement of the communication member with the first downhole restriction.

The communication member and/or the first downhole restriction may be configured to form a first downhole seal when the communication member engages the first downhole restriction.

The apparatus may be configured to permit pumping of fluid downhole against the action of the first downhole seal to cause a change in downhole fluid pressure which serves to actuate the first indexing mechanism.

The apparatus may be configured to permit release of the communication member from engagement with the first downhole restriction (e.g. to permit release of the communication member from the first and/or second downhole receivers). This may have the effect of breaking the first downhole seal.

The communication member and/or the first downhole restriction may be deformable. This may permit the communication member and/or the first downhole restriction to deform sufficiently when fluid is pumped against the action of the first downhole seal to permit the communication member to pass through the first downhole restriction.

The apparatus may comprise a second downhole restriction such as a second downhole seat for receiving the communication member (e.g. the second downhole receiver may comprise the second downhole restriction).

The second downhole restriction may be configured for engagement with the communication member.

The apparatus may be configured to actuate the second indexing mechanism in response to engagement of the communication member with the second downhole restriction.

The communication member and/or the second downhole restriction may be configured to form a second downhole seal when the communication member engages the second downhole restriction.

The apparatus may be configured to permit pumping of fluid downhole against the action of the second downhole seal to cause a change in downhole fluid pressure which serves to actuate the second indexing mechanism.

The apparatus may be configured to permit release of the communication member from engagement with the second downhole restriction. This may have the effect of breaking the second downhole seal.

The communication member and/or the second downhole restriction may be deformable. This may permit the communication member and/or the second downhole restriction to deform sufficiently when fluid is pumped against the action of the second downhole seal to permit the communication member to pass through the second downhole restriction.

The communication member may comprise a Radio Frequency Identification (RFID) tag.

The apparatus may comprise a downhole RFID tag reader for detecting the proximity of the RFID tag to the downhole RFID tag reader. For example, the downhole receiver(s) may comprise a RFID tag reader(s).

The apparatus may be configured to actuate the first and second indexing mechanisms in response to the detected proximity of the RFID tag to the RFID tag reader.

The apparatus may comprise first and second downhole RFID tag readers for detecting the proximity of the RFID tag.

The apparatus may be configured to actuate the first indexing mechanism in response to the detected proximity of the RFID tag to the first downhole RFID tag reader.

The apparatus may be configured to actuate the second indexing mechanism in response to the detected proximity of the RFID tag to the second downhole RFID tag reader.

The apparatus may comprise a first downhole receiver for receiving and/or detecting a first communication member at a first downhole location.

The apparatus may be configured to actuate the first indexing mechanism in response to receipt and/or detection of the first communication member by the first downhole receiver.

The apparatus may comprise a first downhole restriction for receiving the first communication member, wherein the apparatus is configured to actuate the first indexing mechanism in response to engagement of the first communication member with the first downhole restriction.

The first communication member and/or the first downhole restriction may be configured to form a first downhole seal when the communication member engages the first downhole restriction to permit pumping of fluid downhole against the action of the first downhole seal to cause a change in downhole fluid pressure which serves to actuate the first indexing mechanism.

The apparatus may be configured to permit release of the first communication member from engagement with the first downhole restriction.

The first communication member and/or the first downhole restriction may be deformable.

The apparatus may comprise a second downhole receiver for receiving and/or detecting a second communication member at a second downhole location.

The apparatus may be configured to actuate the second indexing mechanism in response to receipt and/or detection of the second communication member by the second downhole receiver.

The apparatus may comprise a second downhole restriction for receiving the second communication member, wherein the apparatus is configured to actuate the second indexing mechanism in response to engagement of the second communication member with the second downhole restriction.

The second communication member and/or the second downhole restriction may be configured to form a second downhole seal when the second communication member engages the second downhole restriction to permit pumping of fluid downhole against the action of the second downhole seal to cause a change in downhole fluid pressure which serves to actuate the second indexing mechanism.

The apparatus may be configured to permit release of the second communication member from engagement with the second downhole restriction.

The second communication member and/or the second downhole restriction may be deformable.

The first and second communication members may be identically configured.

The first and second communication members may have the same size and/or shape.

The first and second communication members may be differently configured.

The first and second communication members may have a different size and/or shape.

At least one of the first and second communication members may comprise a ball or a dart.

At least one of the first and second communication members may comprise a Radio Frequency Identification (RFID) tag.

The apparatus may comprise a first downhole Radio Frequency Identification (RFID) tag reader.

The apparatus may be configured to actuate the first indexing mechanism in response to the detected proximity of a Radio Frequency Identification (RFID) tag of the first communication member to the first downhole Radio Frequency Identification (RFID) tag reader.

The apparatus may comprise a second downhole Radio Frequency Identification (RFID) tag reader.

The apparatus may be configured to actuate the second indexing mechanism in response to the detected proximity of a Radio Frequency Identification (RFID) tag of the second communication member to the second downhole Radio Frequency Identification (RFID) tag reader. At least one of the first and second indexing mechanisms may comprise a pair of inter-engaging members. At least one of the inter-engaging members may be configured so as to define sequential indexing positions within a cycle, each indexing position corresponding to an operational state of a corresponding downhole tool.

At least one of the first and second indexing mechanisms may comprise a pair of inter-engaging clutch members.

At least one of the first and second indexing mechanisms may comprise a cam member and a cam follower member.

At least one of the first and second indexing mechanisms may comprise an indexing pin and an indexing sleeve having a continuous slot formed around a circumference thereof, wherein the indexing pin engages the slot.

The indexing pin may extend at least partially into the slot.

The slot may extend at least partially through the indexing sleeve.

The slot may define a cycle having at least three sequential indexing positions around the circumference of the indexing sleeve, wherein each indexing position corresponds to an operational state of the first downhole tool.

The slot may define a cycle having at least two sequential indexing positions around the circumference of the indexing sleeve, wherein each indexing position corresponds to an operational state of the second downhole tool.

At least one of the first and second indexing mechanisms may comprise a plurality of indexing pins and an indexing sleeve having a continuous slot formed around a circumference thereof, wherein the indexing pins engage the slot. For each of the indexing pins, the slot may define a cycle of at least two sequential indexing positions, wherein the cycles are identical and extend consecutively around the circumference of the indexing sleeve. For each of the indexing pins, the slot may define a cycle of at least three sequential indexing positions, wherein the cycles are identical and extend consecutively around the circumference of the indexing sleeve. The use of a plurality of indexing pins in this way may provide a more robust indexing mechanism.

The apparatus may comprise a housing.

Each of the indexing sleeves of the first and second indexing mechanisms may be rotatable relative to the housing.

Each of the slots of the first and second indexing mechanisms may be configured to cause rotation of the corresponding indexing sleeve relative to the housing in response to an axial movement of the corresponding indexing pin.

Each of the indexing sleeves of the first and second indexing mechanisms may be configured for axial movement under the action of an axial force, for example, an axial force provided by a piston in response to fluid pressure exerted on the piston.

The piston may be biased in an axial direction by a bias member. For example, the piston may be biased in an axial direction by a compression spring aligned in the axial direction.

Each of the indexing sleeves of the first and second indexing mechanisms may be configured for axial movement under the action of an axial force, for example, an axial force provided by a corresponding piston in response to fluid pressure exerted on the corresponding piston.

Each of the pistons may be biased in an axial direction by a corresponding bias member. For example, each piston may be biased in an axial direction by a corresponding compression spring aligned in the axial direction.

According to a second aspect of the present invention there is provided a method for use in controlling first and second downhole tools, comprising:

associating a first downhole tool with a first cyclical indexing mechanism, wherein said first indexing mechanism defines at least three sequential indexing positions within a cycle, wherein each indexing position corresponds to an operational state of the first downhole tool;

associating a second downhole tool with a second cyclical indexing mechanism, wherein said second indexing mechanism defines at least two sequential indexing positions within a cycle, wherein each indexing position corresponds to an operational state of the second downhole tool; and actuating the first and second indexing mechanisms via a common stimulus to cause said first and second indexing mechanisms to advance between respective indexing positions so as to permit co-ordination of the operational states of the associated first and second downhole tools.

The method may permit the co-ordination of operational states for the first and second downhole tools in a preferred co-ordinated cyclical sequence to permit the first and second downhole tools to perform a desired downhole operation.

The method may provide greater flexibility in the number and/or sequence of operational states of the first and second downhole tools than that provided by known methods for use in controlling first and second downhole tools. This may permit greater control over the co-ordination of the operation of the first and second downhole tools compared with known methods.

The method may permit the co-ordinated reconfiguration of the operational state of the first and/or second downhole tools by advancing the indexing positions of the first and second indexing mechanisms in response to a single common stimulus. This may have the advantage of simplifying and/or speeding up downhole operations compared with known methods for use in controlling first and second downhole tools.

When the first indexing mechanism defines three sequential indexing positions within a cycle and the second indexing mechanism defines two sequential indexing positions within a cycle, the resulting co-ordinated cyclical sequence of operational states for the first and second downhole tools may comprise six predetermined combinations of operational states within a cycle.

The second indexing mechanism may define at least three sequential indexing positions within a cycle.

When the first and second indexing mechanisms each define three sequential indexing positions within a cycle, the resulting co-ordinated cyclical sequence of operational states for the first and second downhole tools may comprise three predetermined combinations of operational states within a cycle.

At least two sequential indexing positions of the first indexing mechanism may correspond to the same operational state.

At least two sequential indexing positions of the first indexing mechanism may correspond to different operational states.

At least two sequential indexing positions of the second indexing mechanism may correspond to the same operational state.

At least two sequential indexing positions of the second indexing mechanism may correspond to different operational states.

Each of the first and second downhole tools may have a plurality of different operational states.

Each of the first and second downhole tools may have an activated operational state and a de-activated operational state. For example, each of the first and second downhole tools may have an activated operational state in which the downhole tool is in a radially extended configuration and a de-activated operational state in which the downhole tool is in a radially retracted configuration. Each of the first and second downhole tools may have an activated operational state denoted ON and a de-activated operational state denoted OFF.

When the first and second indexing mechanisms each define three sequential indexing positions within a cycle, the resulting co-ordinated cyclical sequence of operational states for the first and second downhole tools may comprise (OFF, OFF), (OFF, ON) and (ON, OFF), where the first operational state of each co-ordinated pair of operational states in the sequence corresponds to the first downhole tool and the second operational state of each co-ordinated pair of operational states corresponds to the second downhole tool.

When the first and second indexing mechanisms each define three sequential indexing positions within a cycle, the resulting co-ordinated cyclical sequence of operational states for the first and second downhole tools may comprise (OFF, OFF), (OFF, ON) and (ON, ON).

The method may comprise associating further downhole tool(s) with a corresponding further cyclical indexing mechanism. Each further indexing mechanism may define at least two sequential indexing positions within a cycle, wherein each indexing position corresponds to an operational state of the corresponding further downhole tool(s). The method may comprise actuating the further indexing mechanism(s) via the common stimulus to cause said further indexing mechanism(s) to advance between indexing positions so as to co-ordinate the operational states of the associated further downhole tool(s) with the operational states of the first and second downhole tools in a cyclical sequence.

The method may comprise sending a common stimulus such as a pressure signal, a pressure event, a pressure pulse, a mud pulse, an acoustic signal, an electrical signal, an electromagnetic signal and/or the like from surface so as to actuate the first and second indexing mechanisms.

The method may comprise actuating the first and second indexing mechanisms via the common stimulus at the same time or at different times, for example one after the other.

The method may comprise sending a communication member downhole, for example from surface, and receiving and/or detecting the communication member downhole.

The communication member may comprise a ball, dart and/or the like.

The method may comprise dropping and/or pumping the communication member from surface.

The method may comprise actuating the first and second indexing mechanisms in response to receipt and/or detection of the communication member downhole.

The method may comprise using a downhole receiver to receive and/or detect the communication member at a downhole location. The method may comprise actuating the first and second indexing mechanisms in response to receipt and/or detection of the communication member by the downhole receiver.

The method may comprise using a first downhole receiver to receive and/or detect the communication member at a first downhole location.

The method may comprise actuating the first indexing mechanism in response to receipt and/or detection of the communication member by the first downhole receiver.

The method may comprise using a second downhole receiver to receive and/or detect the communication member at a second downhole location.

The method may comprise actuating the second indexing mechanism in response to receipt and/or detection of the communication member by the second downhole receiver.

The method may comprise receiving the communication member in a downhole restriction such as a downhole seat.

The method may comprise engaging the communication member with the downhole restriction.

The method may comprise actuating the first and second indexing mechanisms in response to engagement of the communication member with the downhole restriction.

The method may comprise forming a downhole seal by engaging the communication member with the downhole restriction.

The method may comprise pumping fluid downhole against the action of the downhole seal to cause a change in downhole fluid pressure which serves to actuate the first and second indexing mechanisms.

The method may comprise engaging the communication member with a first downhole restriction such as a first downhole seat.

The method may comprise actuating the first indexing mechanism in response to engagement of the communication member with the first downhole restriction.

The method may comprise forming a first downhole seal by engaging the communication member with the first downhole restriction.

The method may comprise pumping fluid downhole against the action of the first downhole seal to cause a change in downhole fluid pressure which serves to actuate the first indexing mechanism.

The method may comprise releasing the communication member from engagement with the first downhole restriction. This may have the effect of breaking the first downhole seal.

The method may comprise pumping fluid downhole against the action of the first downhole seal so as to deform the first downhole restriction and/or the communication member sufficiently to permit the communication member to pass through the first downhole restriction.

The method may comprise engaging the communication member with a second downhole restriction such as a second downhole seat.

The method may comprise actuating the second indexing mechanism in response to engagement of the communication member with the second downhole restriction.

The method may comprise forming a second downhole seal by engaging the communication member with the second downhole restriction.

The method may comprise pumping fluid downhole against the action of the second downhole seal to cause a change in downhole fluid pressure which serves to actuate the second indexing mechanism.

The method may comprise releasing the communication member from engagement with the second downhole restriction.

The method may comprise pumping fluid downhole against the action of the second downhole seal so as to deform the second downhole restriction and/or the communication member sufficiently to permit the communication member to pass through the second downhole restriction.

When the communication member engages the first downhole restriction, downhole pressure above the first downhole restriction may be increased by pumping fluid from surface to cause the first indexing mechanism to advance to the next indexing position and to thereby define the next operational state for the first downhole tool. During actuation of the first indexing mechanism, the downhole pressure below the first downhole restriction may remain unchanged. Once the first indexing mechanism has advanced from one indexing position to the next indexing position, the communication member may be released from the first downhole restriction and may be pumped towards the second downhole restriction. When the communication member engages the second downhole restriction, downhole pressure above the second downhole restriction may be increased by pumping from surface to cause the second indexing mechanism to advance to the next indexing position and to thereby define the next operational state for the second downhole tool without causing a change in the indexing position of the first indexing mechanism. In this way, the same communication member may be used to actuate the first indexing mechanism at a first instant and to actuate the second indexing mechanism at a second instant later than the first instant so as to co-ordinate the operational states for the first and second downhole tools.

The communication member may comprise a Radio Frequency Identification (RFID) tag.

The method may comprise detecting the proximity of the RFID tag to a downhole RFID tag reader.

The method may comprise actuating the first and second indexing mechanisms in response to the detected proximity of the RFID tag to the RFID tag reader.

The method may comprise detecting the proximity of the RFID tag to first and second downhole RFID tag readers.

The method may comprise actuating the first indexing mechanism in response to the detected proximity of the RFID tag to the first downhole RFID tag reader.

The method may comprise actuating the second indexing mechanism in response to the detected proximity of the RFID tag to the second downhole RFID tag reader.

The first and second downhole tools may be joined and/or share a common housing.

The first and second downhole tools may form part of the same tubing string, drill string or the like.

The first and second downhole tools may be the same or different.

The first and/or second downhole tools may comprise an under reamer, a stabilizer for stabilizing an under reamer, a centralizer, a cutter, a drill, a directional drilling mechanism, a packer, a bridge plug, a straddle, a perforation gun, a slip, a gripping element and/or the like.

It should be understood that one or more of the optional features disclosed in connection with the first aspect may apply alone or in any combination in relation to the second aspect.

According to a third aspect of the present invention there is provided a method for use in controlling first and second under reamers, comprising:

associating a first under reamer with a first cyclical indexing mechanism, wherein said first indexing mechanism defines at least three sequential indexing positions within a cycle, wherein each indexing position corresponds to an operational state of the first under reamer;

associating a second under reamer with a second cyclical indexing mechanism, wherein said second indexing mechanism defines at least two sequential indexing positions within a cycle, wherein each indexing position corresponds to an operational state of the second under reamer; and actuating the first and second indexing mechanisms via a common stimulus to cause said first and second indexing mechanisms to advance between respective indexing positions so as to permit co-ordination of the operational states of the associated first and second under reamers.

The first and second under reamers may be joined and/or share a common housing.

The first and second under reamers may form part of the same tubing string, drill string or the like.

It should be understood that one or more of the optional features disclosed in connection with the first aspect may apply alone or in any combination in relation to the third aspect.

According to a fourth aspect of the present invention there is provided a method for use in controlling an under reamer and a stabilizer for stabilizing an under reamer, comprising:

associating an under reamer with a first cyclical indexing mechanism, wherein said first indexing mechanism defines at least three sequential indexing positions within a cycle, wherein each indexing position corresponds to an operational state of the under reamer;

associating a stabilizer for stabilizing the under reamer with a second cyclical indexing mechanism, wherein said second indexing mechanism defines at least two sequential indexing positions within a cycle, wherein each indexing position corresponds to an operational state of the stabilizer; and actuating the first and second indexing mechanisms via a common stimulus to cause said first and second indexing mechanisms to advance between respective indexing positions so as to permit co-ordination of the operational states of the associated under reamer and the associated stabilizer.

The under reamer and the stabilizer may be joined and/or share a common housing.

The under reamer and the stabilizer may form part of the same tubing string, drill string or the like.

It should be understood that one or more of the optional features disclosed in connection with the first aspect may apply alone or in any combination in relation to the fourth aspect.

According to a further aspect of the invention, there is provided a tubing or drill string comprising at least a first reamer and a second reamer; wherein the first and second reamers are independently actuatable.

Independent actuation may comprise independent reconfiguration. For example, the first reamer may be reconfigurable between a first configuration and a second configuration whilst the second reamer remains in a same configuration (e.g. a first configuration of the second reamer).

Reconfiguration may comprise extension or retraction. For example, the/each reamer may be reconfigurable between a retracted configuration and an extended configuration.

During under reaming of extended sections or sections of hard and/or highly abrasive rock formations where severe cutter wear is expected, it may be desirable to run more than one under reamer on a drill string. This may permit different under reamers to under ream different sections of the well bore.

The first and second reamers may be configured to ream a same section of bore.

The first and second reamers may be configured to ream different sections of the bore.

The first and second reamers may comprise different properties. The first reamer may be configured to ream to a first gauge; such as to ream a first section of bore. The second reamer may be configured to ream to a second gauge, the second gauge different from the first gauge.

Additionally, or alternatively, the first and second reamers may comprise identical or similar properties. For example, the first and second reamers may be configured to ream to a similar gauge.

One of the reamers may comprise an auxiliary or reserve reamer. For example, the second reamer may be a back-up reamer, such as for use in the event of failure or wear of the first reamer. Accordingly, the first reamer may initially be used to ream a section of bore until the first reamer is worn; whereupon the first reamer may be deactuated and the second reamer actuated to continue reaming, or to ream a second section of bore. Providing an auxiliary or reserve reamer may allow the continuation of reaming or further reaming without retrieving the drillstring.

Deactuation may comprise reconfiguring the reamer between the second and first configurations. For example, deactuation may comprise retraction of the reamer (or of the reamer's cutters).

The/each reamer may comprise an under reamer.

The/each reamer may comprise a multi-cycle reamer.

The/each reamer may be pivotally and/or linearly extendable, such as radially extendable (e.g. the reamer's cutters may be pivotally and/or linearly extendable).

The reamers may be selectively independently actuatable and/or selectively independently deactuatable. For example, the first reamer may be independently actuatable from the second reamer for at least a portion of a downhole operation. The first reamer may be substantially simultaneously or dependently actuatable together with the second reamer for at least another portion of a downhole operation.

The drillstring may be configured to co-ordinate the configurations or operational states of the different downhole tools.

The drillstring may comprise an indexing mechanism. For example, the drill string may comprise the indexing mechanisms of the first aspect of the present invention.

The drillstring may be configured to repeatedly actuate and/or deactuate the first and/or second reamers.

According to a further aspect of the invention, there is provided a method of actuating or controlling a reamer, the method comprising:

providing at least a first and a second reamer on a drill string;

actuating or deactuating the first reamer independently of the second reamer.

The method may comprise actuating the second reamer independently of the first reamer.

The method may comprise running in and/or retrieving the reamers simultaneously on the single drill string.

The method may comprise providing a drill bit on the drill string. The method may comprise providing a pilot drill bit and a hole-opening bit on the drill string.

The method may comprise actuating additional tools; such as additional reamers and/or other tools (e.g. one or more stabilizers).

The method may comprise cyclically actuating the first reamer independently of the second reamer and actuating the first reamer substantially synchronously or coordinated with the second reamer.

The method may comprise cyclically deactuating the first reamer independently of the second reamer and deactuating the first reamer substantially synchronously or coordinated with the second reamer.

The method may comprise cyclically actuating and deactuating the first reamer independently of the second reamer.

The method may comprise cyclically actuating or deactuating the first reamer substantially synchronously or coordinated with the second reamer.

The method may comprise the method for use in controlling first and second downhole tools (e.g. first and second reamers) of the second aspect.

The method may comprise reaming with the first reamer actuated and the second reamer deactuated (e.g. reaming with only the first reamer).

The method may comprise reaming with the first reamer actuated and the second reamer actuated. For example, both reamers may be simultaneously actuated, such as to ream to different gauges in a same section of bore (e.g. to progressively/sequentially ream). Both reamers may be simultaneously actuated such as to ream two sections of bore simultaneously (e.g. with the first reamer below a constriction, and the second reamer above a constriction).

The method may comprise reaming with the first reamer deactuated and the second reamer actuated (e.g. reaming with only the second reamer).

The method may comprise translating the drillstring in the bore with both reamers deactuated.

The method may comprise sequentially actuating and deactuating the reamers to perform any combination of simultaneously reaming with both reamers and/or individually reaming with the first or the second reamer and/or translating with the reamers deactuated.

The method may comprise repeatedly actuating and/or deactuating the first and/or second reamers.

The method may comprise mounting the first and second reamers in the drill string axially displaced relative to each other. For example, the first reamer may be a lower reamer and the second reamer may be an upper reamer.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the coupling portion of one aspect may comprise features of any other aspect). Optional features as recited in respect of a method may be additionally applicable to an apparatus; and vice versa. For example, an apparatus may be configured to perform any of the steps or functions of a method.

In addition, corresponding means for performing one or more of the discussed functions are also within the present disclosure.

It will be appreciated that one or more embodiments/aspects may be useful in selectively actuating first and/or second downhole tool, such as independently actuating first and second under reamers.

The above summary is intended to be merely exemplary and non-limiting.

BRIEF DESCRIPTION OF THE DRAWINGS

The present invention will now be described by way of non-limiting example only with reference to the following drawings of which:

FIG. 4(*b*) is a schematic unwrapped view of the respective indexing sleeve and pin positions of the upper and lower indexing mechanisms of the apparatus of FIG. 1 for a second indexing position;

FIG. 4(*c*) is a schematic unwrapped view of the respective indexing sleeve and pin positions of the upper and lower indexing mechanisms of the apparatus of FIG. 1 for a third indexing position;

FIG. 5(*b*) is a schematic illustration of the drill string of FIG. 1 for the second indexing position in which the upper under reamer is de-activated but the lower under reamer is activated;

FIG. 5(*c*) is a schematic illustration of the drill string of FIG. 1 for the third indexing position in which the upper under reamer is activated but the lower under reamer is de-activated;

FIG. 7(*b*) is a schematic unwrapped view of the respective indexing sleeve and pin positions of upper and lower indexing mechanisms of the apparatus of FIG. 6 for a second indexing position;

FIG. 7(*c*) is a schematic unwrapped view of the respective indexing sleeve and pin positions of upper and lower indexing mechanisms of the apparatus of FIG. 6 for a third indexing position;

FIG. 8(*b*) is a schematic illustration of the drill string of FIG. 6 for the second indexing position in which in which the stabilizer is de-activated but the under reamer is activated; and FIG. 8(*c*) is a schematic illustration of the drill string of FIG. 6 for the third indexing position in which the stabilizer and the under reamer are both activated.

DETAILED DESCRIPTION OF THE DRAWINGS

Figure 1:
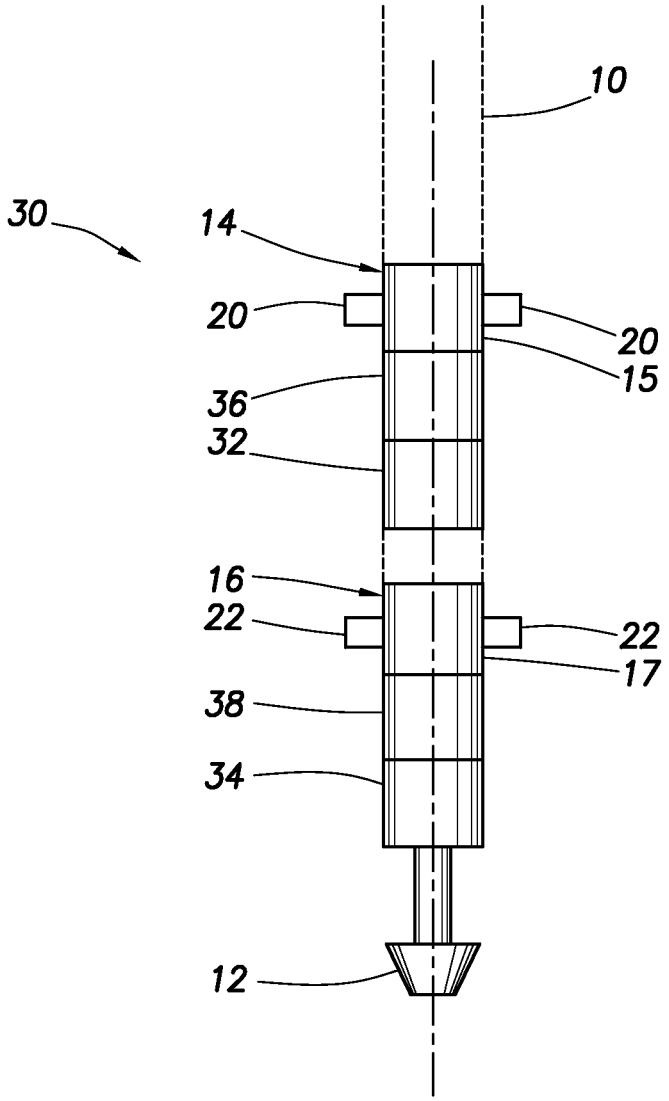
FIG. 1 is a schematic illustration of a drill string comprising upper and lower under reamers and an apparatus for use in controlling the upper and lower under reamers.

Referring initially to FIG. 1 there is shown a drill string generally designated 10 comprising a drill bit 12, an upper under reamer generally designated 14 having a housing 15 and a lower under reamer generally designated 16 having a housing 17. The upper and lower under reamers 14, 16 comprise respective cutting heads 20, 22. The cutting heads 20, 22 are radially extendable with respect to a longitudinal axis of the drill string 10 from a retracted position in which the cutting heads 20, 22 are contained within their respective housings 15, 17, and an extended position shown in FIG. 1 in which the cutting heads 20, 22 protrude radially outwardly beyond their respective housings 15, 17. It should be understood that references to a particular direction or orientation such as "down", "up", "upper", "lower", "above", "below", "side" and the like used throughout the following description apply to a vertical orientation of the drill string 10 and are not intended to be limiting in any way. For example, the drill string 10 may be utilised utilized in vertical, deviated and/or horizontal wellbores.

The drill string 10 further comprises an apparatus generally designated 30 for use in controlling the upper and lower under reamers 14, 16. The apparatus 30 comprises upper and lower indexing mechanisms 32 and 34 respectively and upper and lower actuators 36 and 38 respectively. As described in more detail below, each of the upper and lower indexing mechanisms 32, 34 are configured to advance between respective indexing positions in response to a common stimulus provided by a ball pumped from surface so as to permit co-ordination of the operational states of the upper and lower under reamers 14, 16.

Figure 2:
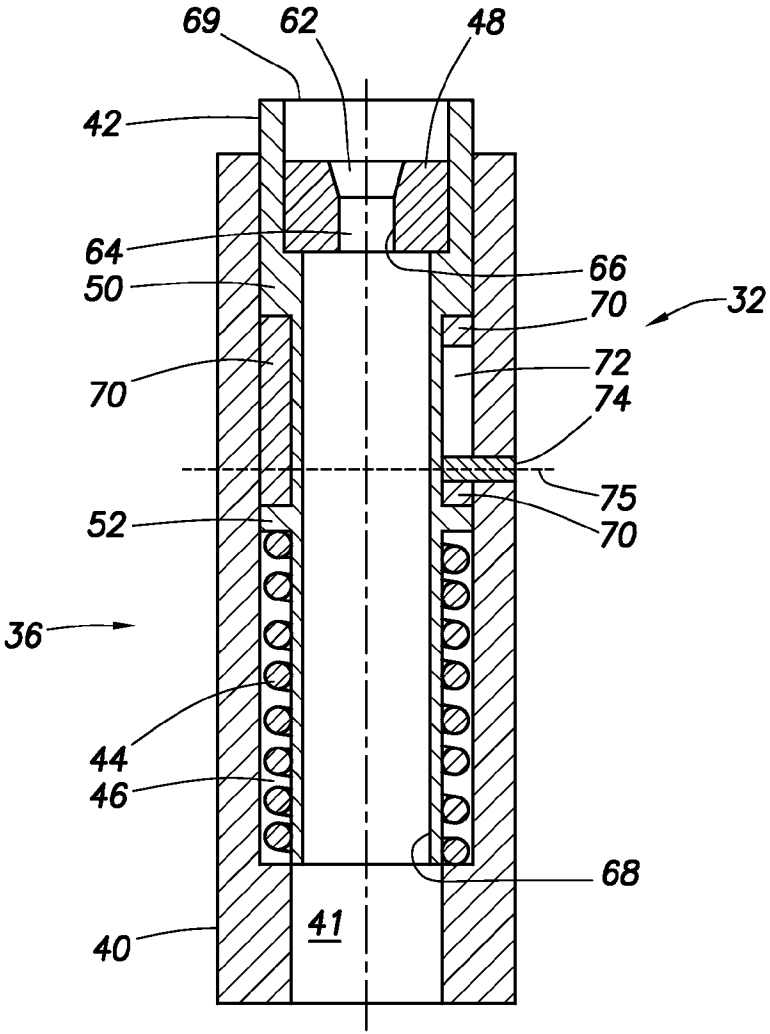
FIG. 2 is a schematic illustration of an upper indexing mechanism of the apparatus of FIG. 1.

FIG. 2 shows the upper indexing mechanism 32 and upper actuator 36 in more detail. The upper indexing mechanism 32 and upper actuator 36 are housed within a common housing 40 which defines a fluid flow path 41. The upper actuator 36 comprises an actuator sleeve 42, a compression spring 44 located within an annular recess 46 formed within the housing 40, and a deformable ball seat 48. The actuator sleeve 42 is movable axially within the housing 40. The actuator sleeve 42 comprises upper and lower flange portions 50 and 52 respectively. The lower flange portion 52 engages an upper end of the compression spring 44 so that the compression spring 44 biases the actuator sleeve 42 upwardly within the housing 40. The ball seat 48 engages the upper flange 50 of the actuator sleeve 42 and is movable axially within the housing 40 together with the actuator sleeve 42. The ball seat 48 comprises a mouth portion 62 for receiving a ball (not shown) and a throat portion 64. The throat portion 64 defines a bore 66 having a diameter which is less than a diameter of an inner bore 68 defined by the actuator sleeve 42. The actuator sleeve 42 further comprises an upper end 69 which engages the upper under reamer 14 (not shown in FIG. 2). One skilled in the art will appreciate that the cutting heads 20 of the upper under reamer 14 may be retracted when the actuator sleeve 42 is in the position shown in FIG. 2 and that the actuator sleeve 42 is movable downwardly relative to the housing 40 against the bias of the compression spring 44 so as to radially extend the cutting heads 20 of the upper under reamer 14 to the extended position shown in FIG. 1.

The upper indexing mechanism 32 comprises an indexing sleeve 70 having a profiled slot 72 formed therein and an indexing pin 74 which extends radially inwardly from the housing 40 along a lateral plane 75 so as to engage the slot 72. The indexing sleeve 70 is contained within an annular recess defined by the upper and lower flanges 50, 52 of the actuator sleeve 42 between the actuator sleeve 42 and the housing 40. The indexing sleeve 70 is rotatable relative to the housing 40 and the actuator sleeve 42. The indexing sleeve 70 is movable axially together with the actuator sleeve 42 and the ball seat 48 relative to the housing 40. The indexing sleeve 70, the actuator sleeve 42 and the ball seat 48 are biased upwardly together by the compression spring 44.

Figure 3:
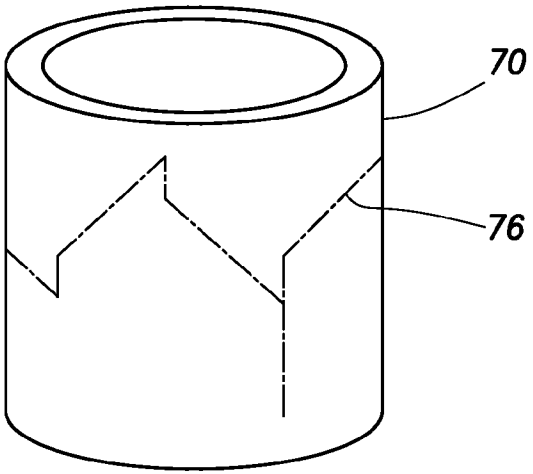
FIG. 3 is a schematic illustration of an indexing sleeve of the upper indexing mechanism of FIG. 2.

FIG. 3 shows a schematic perspective view of the indexing sleeve 70 showing a centerline 76 of the slot 72. The slot 72 extends continuously around a circumference of the indexing sleeve 70. The profile of the slot 72 defines a cyclical sequence shown more clearly in the upper half of each of FIGS. 4(*a*)-4(*c*). The cyclical sequence has three indexing positions within each cycle, wherein each indexing position corresponds to an operational state (ON=radially extended, or OFF=radially retracted) of the upper under reamer 14.

The lower actuator 38 is identical to the upper actuator 36. The lower indexing mechanism 34 comprises an indexing sleeve having a profiled slot 82 formed therein and an indexing pin 84 which extends radially inwardly from a housing along a lateral plane 85 so as to engage the slot 82. The upper and lower indexing mechanisms 32, 34 are identical in all respects except for the profile of the slots 72, 82 formed in the upper and lower indexing sleeves. The respective profiles of the slots 72, 82 are shown in each of FIGS. 4(*a*)-4(*c*). The upper half of each of FIGS. 4(*a*)-4(*c*) shows the profile of the slot 72 of the upper indexing mechanism 32, whilst the lower half of each of FIGS. 4(*a*)-4(*c*) shows the profile of the slot 82 of the lower indexing mechanism 34.

In use, the upper and lower indexing mechanisms 32, 34 are used to control the operational states of the upper and lower under reamers 14, 16 as will now be described, with reference to FIGS. 4(*a*)-4(*c*) and FIGS. 5(*a*)-5(*c*). To permit deployment of the drill string 10 downhole through a casing 88, it is desirable that the cutting heads 20, 22 of the upper and lower under reamers 14, 16 are both initially in the retracted position as shown in FIG. 5(*a*). To ensure that the upper and lower under reamers 14, 16 remain in the retracted position shown in FIG. 5(*a*) during deployment of the drill string 10, the upper and lower indexing sleeves 70, 80, are biased upwardly by respective compression springs so that indexing pins 74, 84 are both initially located in one of the deep troughs 77, 87 of the corresponding slots 72, 82 as shown in FIG. 4(*a*).

Once drilling has proceeded to the depth shown in FIG. 5(*b*) and the lower under reamer 16 is below a lower end of the casing 88, a first ball is dropped or pumped from surface to engage the mouth portion 62 of the deformable ball seat 48 of the upper actuator 36. Once in engagement with the mouth portion 62 of the ball seat 48, the first ball and the ball seat 48 together form a seal to resist further flow of fluid along the fluid flow path 41. Fluid is pumped from surface to increase the fluid pressure acting on the first ball, causing the actuator sleeve 42 and the indexing sleeve 70 to be displaced downwardly together against the bias of the compression spring 44 until a peak 78 of the slot 72 engages the indexing pin 74. The pump rate is increased to further increase the fluid pressure acting on the first ball until the ball seat 48 deforms sufficiently to permit the first ball to pass downwardly through the throat portion 64 of the ball seat 48 thereby relieving the downward pressure acting on the indexing sleeve 70. This results in a net upward force on the actuator sleeve 42 which causes the indexing sleeve 70 to rotate and the actuator sleeve 42 to move upwardly as dictated by the profile of the slot 72 until the next deep trough 77 of the slot 72 engages the indexing pin 74 as shown in the upper half of FIG. 4(*b*). Thus, the axial position of the actuator sleeve 42 relative to the housing 40 before and after passage of the first ball through the ball seat 48 is the same and the cutting heads 20 of the upper under reamer 14 remain in the retracted position as shown in FIG. 5(*b*).

The first ball continues downwardly until the first ball engages a mouth portion of a ball seat of the lower actuator 38 and forms a seal therewith. Fluid is pumped from surface once again to increase the downward pressure acting on an actuator sleeve of the lower actuator 38 causing the actuator sleeve of the lower actuator 38 to move downwardly against the bias of a compression spring of the lower actuator 38 until a peak 86 of the slot 82 engages the indexing pin 84. The pump rate is increased to further increase the fluid pressure acting on the first ball until the ball seat of the lower actuator 38 deforms sufficiently to permit the first ball to pass downwardly through a throat portion of the ball seat of the lower actuator 38 thereby relieving the downward pressure acting on the indexing sleeve 80 of the lower indexing mechanism 34. This results in a net upward force on the actuator sleeve of the lower actuator 38 which causes the indexing sleeve 80 to rotate and the actuator sleeve of the lower actuator 38 to move upwardly as dictated by the profile of the slot 82 until a shallow trough 89 of the slot 82 engages the indexing pin 84 as shown in the lower half of FIG. 4(*b*). This results in the cutting heads 22 of the lower under reamer 16 being extended radially to the extended position shown in FIG. 5(*b*).

Figures 4A, 4B, 4C:
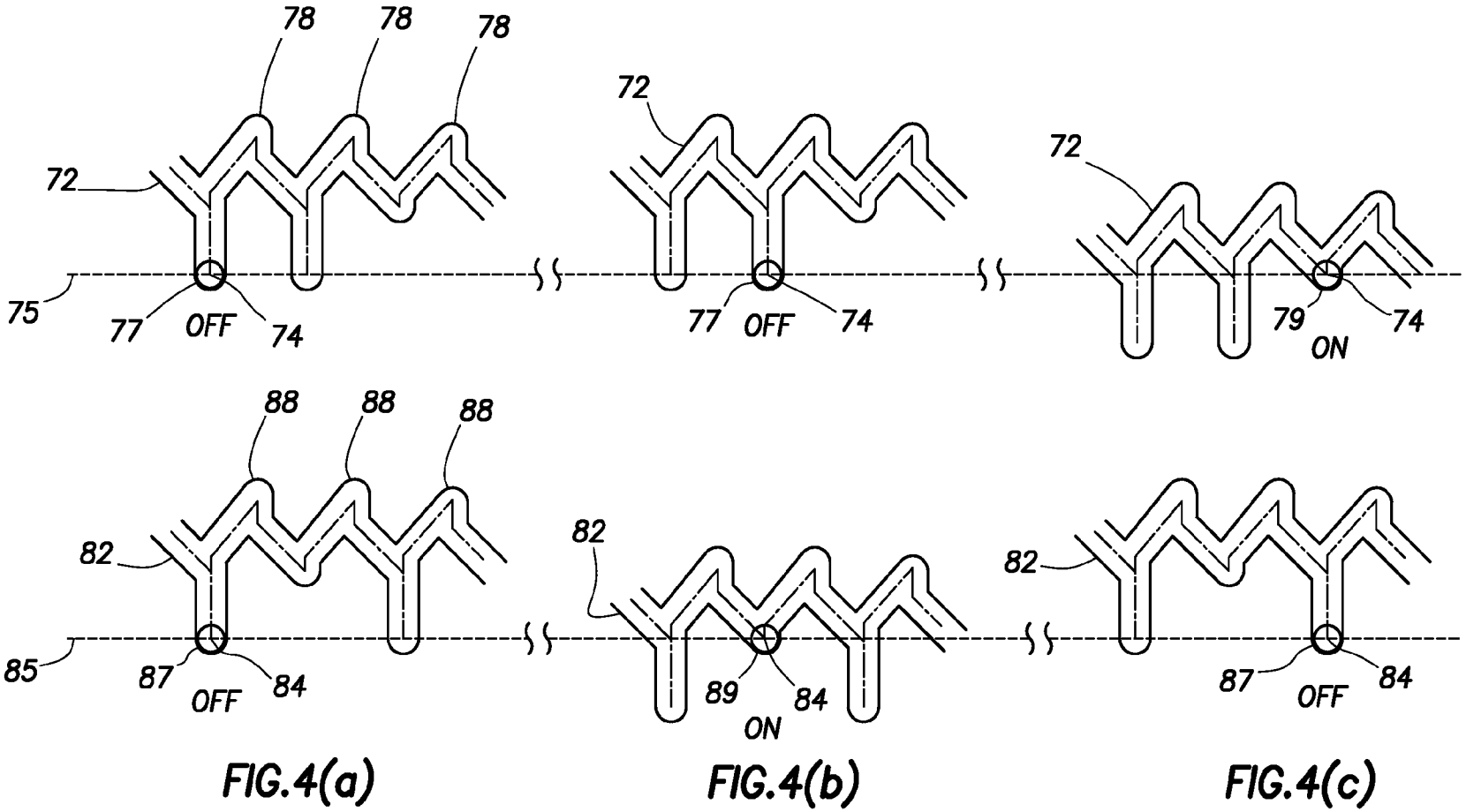
FIG. 4(*a*) is a schematic unwrapped view of the respective indexing sleeve and pin positions of upper and lower indexing mechanisms of the apparatus of FIG. 1 for a first indexing position.
Figure 5C:
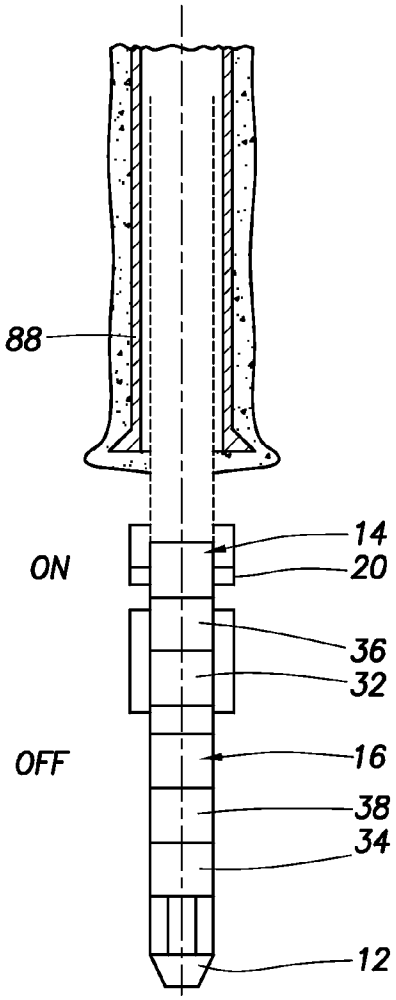
FIG. 5(*a*) is a schematic illustration of the drill string of FIG. 1 for the first indexing position in which the upper and lower under reamers are both de-activated.
Figure 5B:
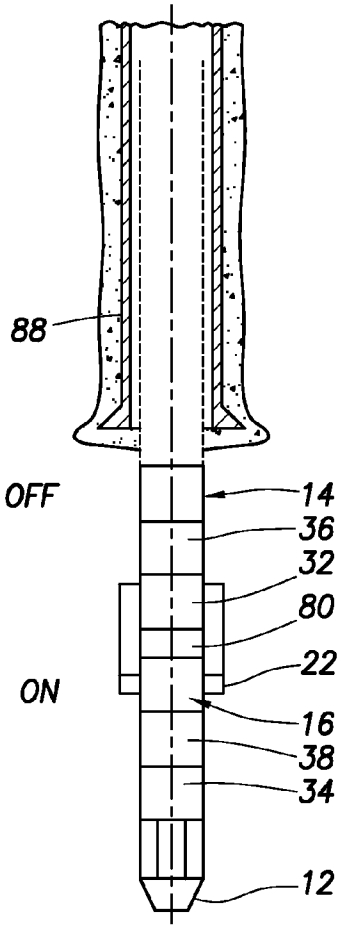
Figure 5A:
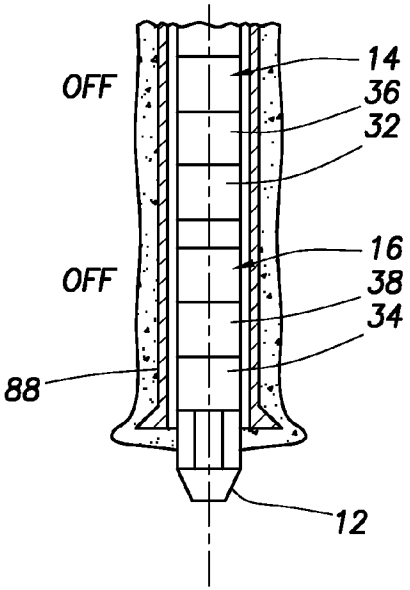

When it is desired to retract the cutting heads 22 of the lower under reamer 16 and extend the cutting heads 20 of the upper under reamer 14 as shown in FIG. 5(*c*), a second ball is pumped from surface to advance the indexing sleeves 70, 80 relative to the respective indexing pins 74, 84 from the positions shown in FIG. 4(*b*) to the positions shown in FIG. 4(*c*) in a similar manner to that described above for the first ball. After passage of the second ball through the ball seat 48 of the upper actuator 36, a shallow trough 79 of the slot 72 engages the indexing pin 74 of the upper indexing mechanism 32 as shown in the upper half of FIG. 4(*c*). This results in the cutting heads 20 of the upper under reamer 14 to be radially extended as shown in FIG. 5(*c*). After passage of the second ball through the ball seat of the lower actuator 38, a deep trough 87 of the slot 82 engages the indexing pin 84 as shown in the lower half of FIG. 4(*c*). This results in radial retraction of the cutting heads 22 of the lower under reamer 16 as shown in FIG. 5(*c*).

When it is desired to retract the cutting heads 20, 22 of the upper and lower under reamers 14, 16 again, for example to permit retrieval of the drilling string 10 through the casing 88, a third ball is pumped from surface to advance the upper and lower indexing sleeves, relative to the respective indexing pins 74, 84 from the positions shown in FIG. 4(*c*) back to the positions shown in FIG. 4(*a*). Thus, the different profiles of the slots 72, 82 of the upper and lower indexing sleeves respectively result in the co-ordinated operation of the upper and lower under reamers 14, 16 to provide the sequence of operations depicted in FIGS. 5(*a*)-5(*c*) respectively.

Figure 6:
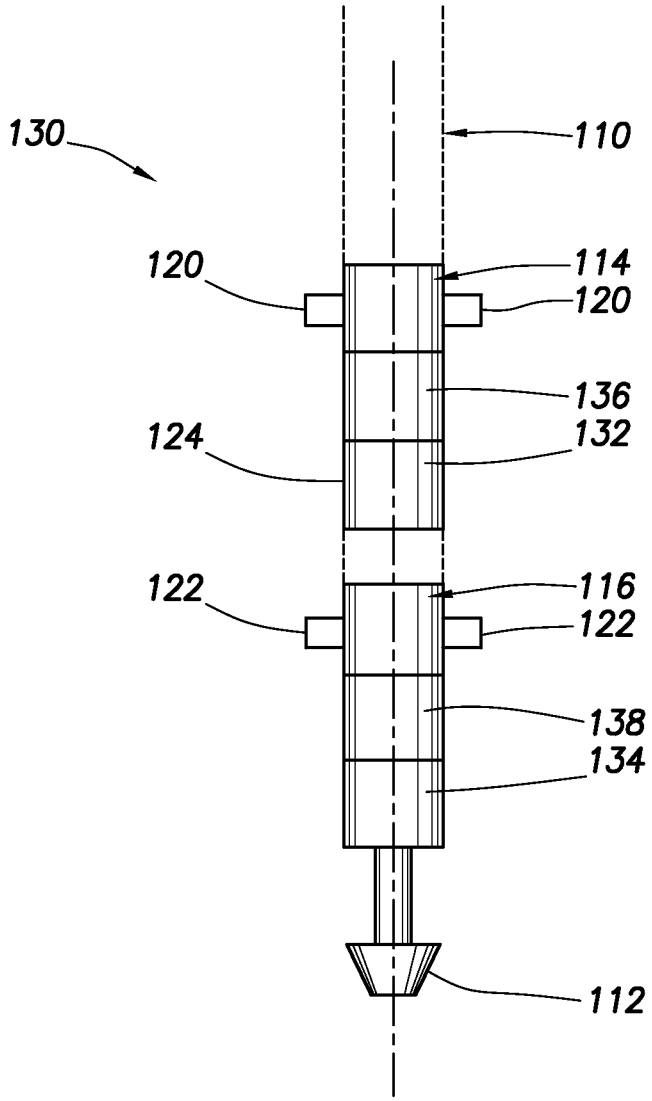
FIG. 6 is a schematic illustration of a drill string comprising an under reamer, a stabilizer for stabilizing the under reamer and an apparatus for use in controlling the stabilizer and the under reamer.

Referring to FIG. 6 there is shown a drill string generally designated 110 comprising a drill bit 112, an under reamer 116 and a stabilizer 114 for retaining the under reamer 116 concentrically within the under reamed section of the borehole. The stabilizer 114 comprises stabilizing projections 120 for engaging the sidewalls of the under reamed section of the borehole. The under reamer 116 comprises cutting heads 122. The stabilizing projections 120 and cutting heads 122 are radially extendable with respect to a longitudinal axis of the drill string 110 from a retracted position in which the stabilizing projections 120 and cutting heads 122 are contained within an outer surface 124 of the drill string 110, and an extended position shown in FIG. 6 in which the stabilizing projections 120 and cutting heads 122 protrude radially outwardly beyond the outer surface 124 of the drill string 110.

Figures 7A, 7B, 7C:
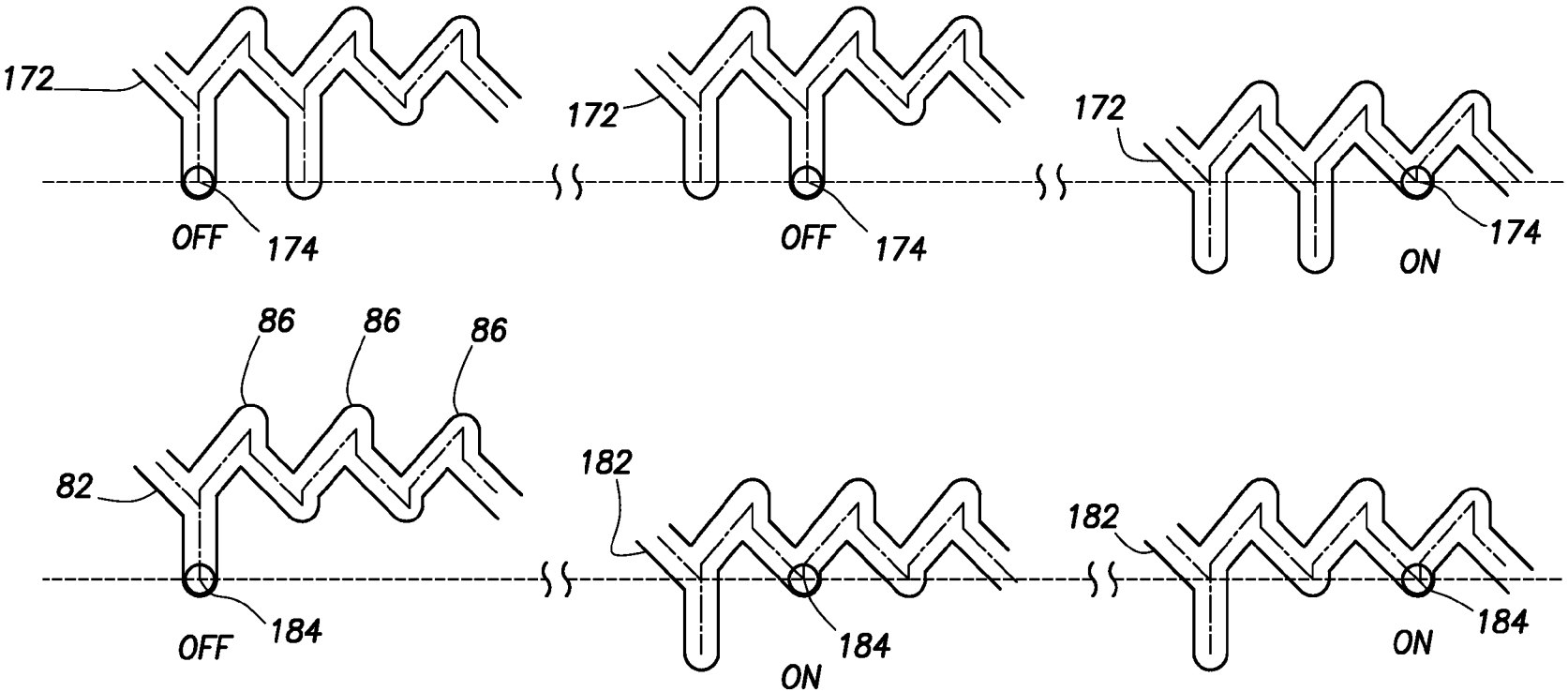
FIG. 7(*a*) is a schematic unwrapped view of the respective indexing sleeve and pin positions of upper and lower indexing mechanisms of the apparatus of FIG. 6 for a first indexing position.
Figure 8C:
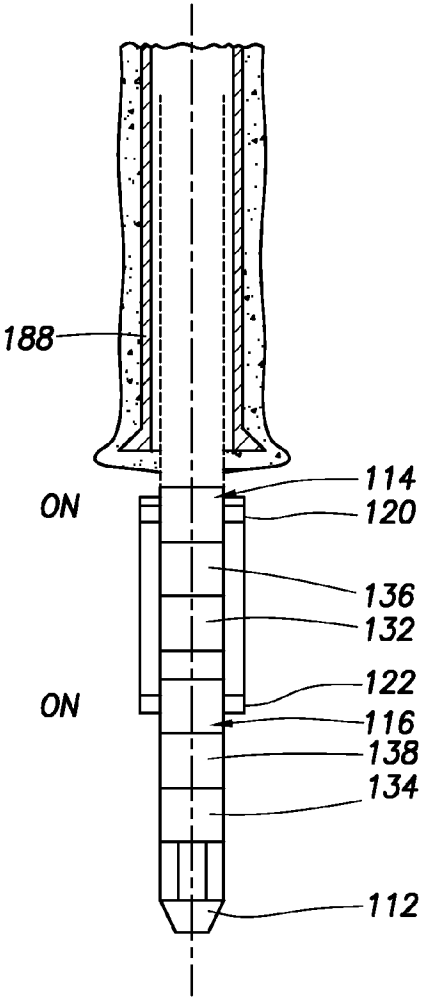
FIG. 8(*a*) is a schematic illustration of the drill string of FIG. 6 for the first indexing position in which the stabilizer and the under reamer are both de-activated.
Figure 8B:
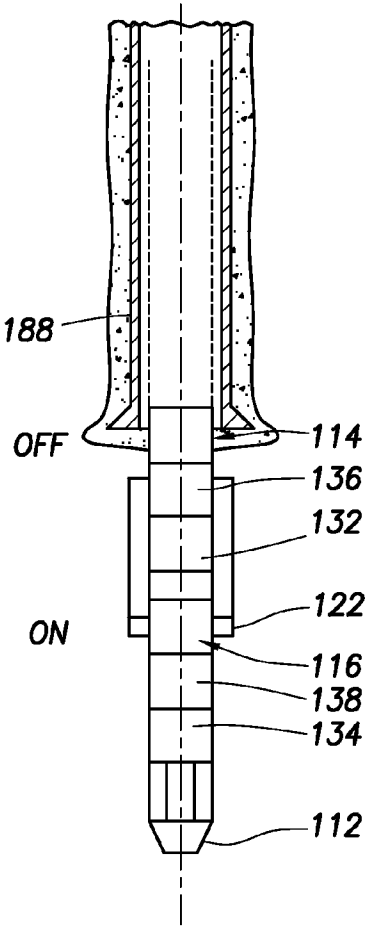
Figure 8A:
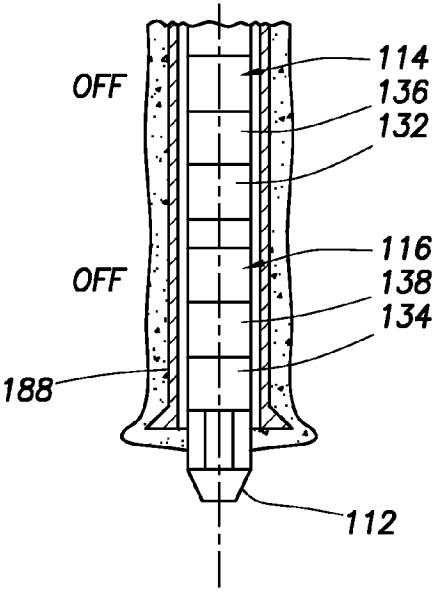

The drill string 110 shares many like features, such as upper and lower indexing mechanisms 132, 134 and upper and lower actuators 136, 138, with the drill string 10 of FIG. 1 and differs only in the profile of the slots 172, 182 formed in upper and lower indexing sleeves respectively as shown in FIGS. 7(*a*)-7(*c*). As such, the drill string 110 is operated in a manner very similar to the manner of operation of the drill string 10 as described above. The different profiles of the slots 172, 182 of the drill string 110 shown in FIGS. 7(*a*)-7(*c*) ensures a different co-ordinated sequence of operations for the drill string 110 as depicted in FIGS. 8(*a*)-8(*c*) respectively. FIG. 8(*a*) shows the drill string 110 during deployment when the stabilizing projections 120 and the cutting heads 122 of the under reamer 116 are both initially in their radially retracted configurations. The corresponding positions of the upper and lower indexing pins 174, 184 relative to the corresponding slots 172, 182 are shown in FIG. 7(*a*). Once the under reamer 116 has cleared the lower end of the casing 188 as shown in FIG. 8(*b*), a first ball may be pumped from surface to advance the positions of the upper and lower indexing sleeves relative to the indexing pins 174, 184 from those shown in FIG. 7(*a*) to those shown in FIG. 7(*b*). This results in radial extension of the cutting heads 122 of the under reamer 116 so that the cutting heads 122 of the under reamer 116 are in their radially extended position whilst while the stabilizing projections 120 of the stabilizer 114 remain in their radially retracted configuration as shown in FIG. 8(*b*). Once the stabilizer 114 has cleared the lower end of the casing 188 as shown in FIG. 8(*c*), a second ball may be pumped from surface to advance the positions of the upper and lower indexing sleeves relative to the indexing pins 174, 184 from those shown in FIG. 7(*b*) to those shown in those shown in FIG. 7(*c*). This results in extension of the stabilizing projections 120 of the stabilizer 114 while the cutting heads 122 of the under reamer 116 remain in their radially extended configuration as shown in FIG. 8(*c*). The stabilizing projections 120 may then serve to stabilize the under reamer 116 during under reamer operations.

One skilled in the art will appreciate that various modifications of the apparatus 30 and the apparatus 130 are possible. For example, although the upper and lower indexing mechanisms 32, 34 are described as having only one indexing pin 74, 84 and one slot 72, 82, it should be understood that the upper and/or lower indexing mechanisms 32, 34 may each comprise a plurality of indexing pins 74, 84, whilst the corresponding slots 72, 82 may each define one cycle of three sequential indexing positions per indexing pin, wherein the cycles are identical and are consecutively arranged around the circumference of the upper and lower indexing sleeves so as to form a continuous slot 72, 82. The use of a plurality of indexing pins in this way may provide a more robust indexing mechanism.

The apparatus 30 may be used to co-ordinate the operational states of downhole tools of any kind. For example, the apparatus 30 may be used to co-ordinate the operational states of any combination of under reamers, stabilizers for stabilizing under reamers, centralizers, cutters, drills, directional drilling mechanisms, packers, bridge plugs, straddles, perforation guns, slips, gripping elements and/or the like.

The number of operational states may be more than two. For example, the slots 72, 82 may be adapted to have troughs of more than two different depths. The number of indexing positions may be more than three.

The number of indexing positions may be at least two for one of the indexing mechanisms and at least three for the other of the indexing mechanisms.

The apparatus 30 may be adapted to co-ordinate the operational states of more than two downhole tools by providing one indexing mechanism and one actuator for each downhole tool.

Rather than pumping a ball from the surface to advance the upper and lower indexing sleeves between indexing positions, a communication member such as a dart or the like may be pumped from the surface.

The communication member may comprise an RFID tag. The upper and lower actuators may each comprise an RFID tag reader to detect the presence of the communication member downhole. The apparatus may be configured to advance the upper and lower indexing sleeves between respective indexing positions in response to the detection of the RFID tag by the respective RFID tag reader. Alternatively, any kind of stimulus may be used to advance the upper and lower indexing sleeves between respective indexing positions. For example, a pressure signal, a pressure event, a pressure pulse, a mud pulse, an acoustic signal, an electrical signal, an electromagnetic signal and/or the like from surface may be used to advance the upper and lower indexing sleeves between respective indexing positions.

As one skilled in the art will appreciate, the upper and lower indexing mechanisms may differ from the indexing pin and slot arrangements described above. For example, each of the upper and lower indexing mechanisms may comprise a pair of inter-engaging members such as a pair of inter-engaging clutch members or a cam member and a cam follower member, wherein one or both of the inter-engaging members are configured so as to define sequential indexing positions within a cycle, each indexing position corresponding to an operational state of a corresponding downhole tool.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. It should be understood that the embodiments described herein are merely exemplary and that various modifications may be made thereto without departing from the scope of the invention.

What is claimed is:

1. An apparatus for use in controlling first and second downhole tools, comprising:

a first cyclical indexing mechanism associated with the first downhole tool, said first cyclical indexing mechanism comprising a first indexing sleeve having a profiled slot therein, the profiled slot having peaks and troughs in a cyclical sequence extending around a circumference of the indexing sleeve defining at least three sequential indexing positions within a cycle, wherein each of the at least three sequential indexing positions corresponds to an operational state of the first downhole tool;

a second cyclical indexing mechanism associated with the second downhole tool, said second cyclical indexing mechanism comprising a second indexing sleeve having a second profiled slot therein, the second profiled slot having peaks and troughs in a cyclical sequence extending around a circumference of the indexing sleeve defining at least two sequential indexing positions within the cycle, wherein each of the at least two sequential indexing positions corresponds to an operational state of the second downhole tool; and at least one actuator for actuating the first and second cyclical indexing mechanisms in response to a common stimulus to cause said first and second cyclical indexing mechanisms to advance between respective indexing positions so as to permit co-ordination of the operational states of an associated one of the first and second downhole tools.

2. The apparatus of claim 1, wherein the second cyclical indexing mechanism defines at least three sequential indexing positions within the cycle.

3. The apparatus of claim 1, wherein the operational states of the first downhole tool for at least two of the at least three sequential indexing positions of the first cyclical indexing mechanism are the same.

4. The apparatus of claim 1, wherein the operational state of the second downhole tool for at least two of the at least two sequential indexing positions of the second cyclical indexing mechanism are the same.

5. The apparatus of claim 1, wherein the at least one actuator comprises a first actuator for actuating the first cyclical indexing mechanism and a second actuator for actuating the second cyclical indexing mechanism.

6. The apparatus of claim 1, wherein the first and second downhole tools form part of the same tubing string or drill string.

7. The apparatus of claim 1, wherein at least one of the first and second downhole tools comprises one of an under reamer, a stabilizer for stabilizing the under reamer, a centralizer, a cutter, a drill, a directional drilling mechanism, a packer, a bridge plug, a straddle, a perforation gun, a slip, and a gripping element.

8. The apparatus of claim 1, wherein the apparatus is configured to receive and/or detect the common stimulus in a form of a communication member downhole; and wherein the apparatus is configured to actuate the first and second cyclical indexing mechanisms in response to the receipt and/or detection of the communication member downhole.

9. The apparatus of claim 8, comprising a first downhole receiver for receiving and/or detecting the communication member at a first downhole location and a second downhole receiver for receiving and/or detecting the communication member at a second downhole location, wherein the apparatus is configured to actuate the first cyclical indexing mechanism in response to the receipt and/or detection of the communication member by the first downhole receiver and to actuate the second cyclical indexing mechanism in response to the receipt and/or detection of the communication member by the second downhole receiver.

10. The apparatus of claim 9, wherein the apparatus is configured to permit release of the communication member from at least one of the first and second downhole receivers.

11. The apparatus of claim 10, wherein the communication member and the first and second downhole receiver(s) are deformable.

12. The apparatus of claim 8, wherein the communication member comprises one of a ball, a dart, and an RFID tag.

13. The apparatus of claim 1, comprising a first downhole receiver for receiving and/or detecting a first communication member at a first downhole location and a second downhole receiver for receiving and/or detecting a second communication member at a second downhole location, wherein the apparatus is configured to actuate the first cyclical indexing mechanism in response to the receipt and/or detection of the first communication member by the first downhole receiver and to actuate the second cyclical indexing mechanism in response to the receipt and/or detection of the second communication member by the second downhole receiver.

14. The apparatus of claim 13, wherein the first and second communication members are identically configured.

15. The apparatus of claim 1, wherein at least one of the first and second cyclical indexing mechanisms comprises a pair of inter-engaging members, at least one of the pair of inter-engaging members being configured so as to define sequential indexing positions within the cycle, each of the sequential indexing positions corresponding to the operational state of the corresponding downhole tool.

16. The apparatus of claim 1, wherein at least one of the first and second cyclical indexing mechanisms comprises a pair of inter-engaging clutch members.

17. The apparatus of claim 1, wherein at least one of the first and second cyclical indexing mechanisms comprises a cam member and a cam follower member.

18. The apparatus of claim 1, wherein the peaks incline and a decline and the trough comprises a vertical slot positioned between the incline and the decline.

19. The apparatus of claim 1, further comprising a pin disposable through the profiled slot.

20. A method for use in controlling first and second downhole tools, comprising:

associating the first downhole tool with a first cyclical indexing mechanism, wherein said first cyclical indexing mechanism comprises a first indexing sleeve having a profiled slot therein, the profiled slot having peaks and troughs in a cyclical sequence extending around a circumference of the indexing sleeve and defining at least three sequential indexing positions within a cycle, wherein each of the at least three sequential indexing positions corresponds to an operational state of the first downhole tool;

associating the second downhole tool with a second cyclical indexing mechanism, wherein said second cyclical indexing mechanism comprises a second indexing sleeve having a second profiled slot therein, the second profiled slot having peaks and troughs in a cyclical sequence extending around a circumference of the indexing sleeve and defining at least two sequential indexing positions within the cycle, wherein each of the at least two sequential indexing positions corresponds to an operational state of the second downhole tool; and actuating the first and second cyclical indexing mechanisms via a common stimulus to cause said first and second cyclical indexing mechanisms to advance between respective indexing positions so as to permit co-ordination of the operational states of an associated one of the first and second downhole tools.

21. The method of claim 20, wherein at least one of the first and second downhole tools comprises one of an under reamer, a stabilizer for stabilizing the under reamer, a centralizer, a cutter, a drill, a directional drilling mechanism, a packer, a bridge plug, a straddle, a perforation gun, a slip and a gripping element.

* * * * *